United States Patent [19]

Hinrichs et al.

[11] Patent Number: 4,584,068

[45] Date of Patent: Apr. 22, 1986

[54] DEVICE AND PROCESS FOR THE FUSED-SALT ELECTROLYSIS OF ALKALI METAL HALIDES

[75] Inventors: Walter Hinrichs; Ludwig Lange, both of Bruehl; Friederich Hammer, Frechen-Habbelrath; Hans Ludwig, Erftstadt, all of Fed. Rep. of Germany

[73] Assignee: Degussa Aktiengesellschaft, Frankfurt, Fed. Rep. of Germany

[21] Appl. No.: 668,051

[22] Filed: Nov. 5, 1984

[30] Foreign Application Priority Data

Nov. 8, 1983 [DE] Fed. Rep. of Germany ..... 3340294

[51] Int. Cl.[4] ..... C25C 3/02

[52] U.S. Cl. ..... 204/68; 204/245; 204/247

[58] Field of Search ..... 204/68, 245, 247

[56] References Cited

U.S. PATENT DOCUMENTS

| | | | |
|---|---|---|---|
| 3,118,827 | 1/1964 | Eckert et al. | 204/68 |
| 3,245,899 | 4/1966 | Brown, Jr. et al. | 204/245 |
| 4,092,228 | 5/1978 | Ross | 204/68 |

*Primary Examiner*—Howard S. Williams

*Attorney, Agent, or Firm*—Beveridge, DeGrandi & Weilacher

[57] ABSTRACT

A device for the fused salt electrolysis of alkali metal halides by the Downs principle becomes operable on an expanded scale, by a process ensuring a favorable thermal economy of the cell, through the incorporation of a double bottom, an improved housing for receiving the anode sleeves, and a differentiatedly heat controllable base, shell, and cover construction with variable current load.

14 Claims, 5 Drawing Figures

DEVICE AND PROCESS FOR THE FUSED-SALT ELECTROLYSIS OF ALKALI METAL HALIDES

The invention relates to a device for the fused salt electrolysis of alkali metal halides according to the Downs principle, operable with a variable current load.

Alkali metals can be produced by electrolysis of a halogen compond of the metal in a melt of the halide provided with additives that reduce the melting point. For the production of sodium by the Downs process, the melt of a ternary salt mixture of sodium chloride, calcium chloride, and barium chloride is electrolyzed at a temperature of approximately 600° C. with direct current at a voltage of 6.2 to 7 V.

The electrolysis is carried out in a device which, in the simplest case, consists of a vessel lined with refractory bricks and receiving the electrolyte, into which a graphite anode is introduced from below, which is surrounded annularly by an iron cathode. A wire mesh screen is arranged as a diaphragm in a non-contacting manner in the gap between the electrodes. To remove the chlorine formed at the anode, a sheet iron bell is arranged above the anode space. This bell, over its outer circumference, carries the so called collector ring to receive the liquid sodium deposited at the cathode. From here, the sodium flows through an iron riser pipe into a storage tank.

In the "so called" Downs cell conventionally used up to now for the industrial production of alkali metals, for example, four cylindrical steel cathode pipes are welded into a unit, enclosing an equal number of cylindrical graphite anodes.

In detail, a known electrolysis device using this cell arrangement contains a vertically arranged group of preferably four cathode/anode pairs in a refractorily lined iron vessel equipped with a cover, which can be provided with an externally applied thermally insulating layer, with each electrode pair consisting of a cylindrical iron cathode connected with current supply arms provided with cooling devices, insulated with respect to the vessel and extending out of it laterally, as well as a cylindrical graphite anode arranged concentrically within the cathode, which is located in a current discharge sleeve or "anode sleeve" conducted through the bottom of the vessel and is cast therein with the use of a low melting alloy, as well as a diaphragm in each case, located in a non-contacting manner in the gap between the cathode and anode, at the upper end of which there is provided the previously mentioned device for the separate collection of metal and halogen, insulated with respect to the vessel, and where a housing equipped with supply and discharge lines for a heat exchange medium is arranged below the bottom of the vessel in the region of the anode sleeves, whose cover consists of the bottom of the vessel and on the bottom of which the anode sleeves are placed. In addition, a single discharge line was provided in the above mentioned housing as an overflow starting above the bottom of the housing, to limit the height of rise of the cooling liquid, but the liquid level was not variable in this case.

With the conventional symmetrical, approximately square arrangement of four electrode pairs located at a distance from each other, two opposite parallel walls of the housing were present as tangents at the circumference of two anode sleeves in each case, while the other two housing walls, which were also parallel to each other, were set back somewhat into the gap between the anode sleeves.

The housing walls welded to the shells of the anode cylinders along their lines of contact accordingly enclosed a cooling space, which was limited to a segment of approximately 61% of the cross section of each anode sleeve, while the externally located segments were not subjected to the action of coolants.

The housing walls were therefore conventionally arranged between the anode sleeves in such a way that the sleeves represented a part of the housing walls. As a result, only approximately 61% of the surfaces of the anode sleeves was located within the housing, so that they could be acted upon by cooling media only on these partial surfaces.

In addition, an additional indirect cooling of the anode sleeves was made possible in each case by two pairs of cooling pipes located above one another, arranged below the bottom of the vessel and conducted centrally through each of the four side walls of the cooling housing, with the first pipe of a first pair, in each case, looping around the internal shell region of an adjacent first anode sleeve in a clockwise direction and the second pipe looping around the same shell region of the adjacent second anode sleeve approximately semicircularly in a counterclockwise direction and leaving the housing above or below the penetration of the pipes of the cooling-pipe pair looping around the two opposite anode sleeves perpendicularly to the direction of entry.

The above mentioned direct and indirect cooling devices, independently of whether they were operated individually or together, burdened the sleeve region with material stresses, since a uniform heat removal through this region is not possible, because of the different heat transmission during direct and indirect cooling, and the heat transfer surfaces in the internal sleeve region are capable of heat removal in only a pointwise and therefore nonuniform manner.

The above described device, which has also been in use in industrial plants for many years, has a capacity of approximately 8.4 metric tons of fused salt and is operated in a completely continuous manner. With a decomposition voltage of, for example, approximately 3.4 V for NaCl and a cell voltage of 6.2–7.0 volts, almost one half of the energy supplied is converted to heat. Part of this is used for melting the continuously inflowing salt and for maintaining the fused mass. With an hourly supply of, for example, 70 to 80 kg of salt and a current load of 41 kA, the excess heat still amounts to approximately 378,000 kJ/hour. This excess heat was removed partly by cooling of the current discharge or anode sleeves and partly by radiation through the vessel shell and cover and by cooling of the current supply pipes to the cathodes.

A characteristic of the type of Downs cell used in the past resides in the fact that the current load capacity of a given cell can be varied only within narrow limits and that it is possible to go above or below the given range only by means of a geometrical increase or decrease in the cell; i.e., by the replacement of a given cell by a newly designed one. This is caused by the fact that the diffusion and circulation processes in the salt melt can be maintained only by means of an optimal energy balance.

Heat buildup, excessive cooling, or unfavorable temperature distribution within the electrolytes; i.e., disturbances in the heat transport of the cell in general, always result in operating problems.

The direct cooling of the anode sleeve region with water carried out up to now, on the one hand, represented a considerable source of danger in the case of a potentially leaking vessel bottom caused by corrosion, promoted in particular by cracking in the ceramic bottom lining; on the other hand, only a limited heat exchange was possible through the only partial integration of the anode sleeve surfaces into the cooling housing. For safety reasons, only the pipes surrounding the anode sleeves in a semicircular manner were used for heat exchange in our plant in most recent times.

However, cooling through the cooling pipes has the disadvantage that a layer of locally solidified melt very easily builds up starting from the bottom of the vessel, which, although it protects the lining of the vessel bottom in the case of a normal height, may possibly increase to a height such that the circulation in the critical spaces that is absolutely necessary for a uniform and undisturbed concentration equalization in the electrolyte bath and, thus, for trouble free operation of the cell is impaired or fails completely.

As a result of the unavoidable progressive removal of the anode graphite caused by chemical attack and abrasion effects, an overheating of the electrolyte may take place. This is because, as a result of the increased electrode spacing, the resistance between the electrodes increases, resulting in a voltage increase. The temperature increase thereby initiated may disturb the circulation of the melt within the cell and, in turn, leads to losses in yield.

On the other hand, an increase in the current load of the cell can lead to a buildup of the excess heat, as a result of which the cell runs hot and provides only a reduced capacity.

If, finally, a cell of the known design is operated with a lower current load, then an increasing solidification of the melt takes place, with the result that the cell can no longer be operated.

As a result of the conditions described, the thermally insulating layers applied to the vessel shell and vessel cover in the known electrolysis devices can also be useful only if a thermal deficiency occurs in the system whereas, if an increase in heat removal becomes necessary, they are a hindrance and must be removed.

Because of the limited possibilities in variation of the heat exchange, the current load capacity for the operation of a known cell is largely preset. According to experience, it is located within the narrow range of 38–43 kA.

The invention is based on the task of eliminating the described deficiencies of the known Downs cell and of creating an improved device for the fused salt electrolysis of alkali metal halides according to the Downs principle, which can be operated in a trouble free manner over a broad range of variable current load.

According to the invention, this task is solved by a device containing a vertically arranged group of preferably four electrode pairs in a refractorily lined iron vessel equipped with a cover, in which each electrode pair consists of a cylindrical iron cathode which is connected with current supply arms provided with cooling devices, insulated with respect to the vessel and extending out of it laterally, as well as a cylindrical graphite anode arranged concentrically within the cathode, which is located in a current discharge sleeve conducted through the bottom of the vessel and is cast therein with the use of a low melting alloy, as well as a diaphragm in each case, located in a non-contacting manner in the gap between the cathode and anode, at whose upper end there is provided a device for the separate collection of metal and halogen (collector ring with collecting bell), known in the art, and where a housing equipped with supply and discharge lines for a heat exchange medium is located below the bottom of the vessel in the region of the current discharge sleeves, whose cover represents the bottom of the vessel and on the bottom of which the current discharge sleeves are placed, and which is characterized by the fact that a second bottom is arranged below the bottom of the vessel, but above the discharge lines for the heat exchange medium and tightly connected with the walls of the housing, where a space is formed between the bottom of the vessel and the second bottom, which may be provided with lateral openings; e.g., slots, through which the bottom of the cell can be checked, by the fact that the housing space located below the second bottom completely surrounds the cylinder shells of the current discharge sleeves, and that the shell of the vessel and the vessel cover, in each case, is designed as a closed double shell provided with supply and discharge lines for a heat exchange medium.

The device according to the invention makes possible a variable supply of different liquid and gaseous heat exchange media to the anode sleeves and to the wall and cover of the iron vessel of the electrolysis cell, and thus the adjustment of optimal operating conditions with current loads of the cell selectable within the broad range of, for example, 25 kA to 45 kA. The second bottom located at a clear distance of approximately 20 to 60 mm, preferably 50 mm, below the bottom of the vessel is welded to the walls of the housing surrounding the anode sleeves, which is preferably approximately square, and to the cylinder shells of the anode sleeves and forms a double bottom together with the bottom of the vessel. In this way, a cavity is formed below the bottom of the vessel, which can be provided with lateral openings, through which a heat exchange medium can be supplied and discharged if necessary.

The double bottom has a twofold function: it provides safety in the case of a possible penetration of the melt through the bottom of the vessel, because the melt can no longer come into contact with a liquid heat exchange medium that may be used. In addition, the cavity limited by it in an upward and downward direction reduces the heat discharge from the bottom of the cell, so that an intended heat exchange between the salt melt and heat exchange medium essentially takes place only through the anodes.

In this way, it becomes possible to limit the height of the protective layer of solidified melt that is, in itself, desirable on the lining of the vessel bottom in such a way that the required undisturbed circulation of the melt is ensured.

Another important characteristic of the device according to the invention for heat exchange in the housing surrounding the anode sleeves resides in the fact that the anode sleeves can now be acted upon by the heat exchange medium over their whole shell surface within the housing walls surrounding them at a clear distance, which was not the case with the previously conventional device. In this way, material stresses in the anodes and the anode removal are reduced, as compared with the previously conventional design.

In this way, the previously carried out indirect cooling of the anode sleeves by means of the cooling pipes surrounding the latter in a semicircular manner also becomes unnecessary. The double bottom and the altered cooling housing design have a favorable effect on the processes during the electrolysis, predominantly in the region of the vessel bottom and the anode; in this way, in combination with the proposed design of the vessel shell and vessel cover as a hollow double shell that can be acted upon by a liquid (high boiling) or gaseous heat exchange medium, the current load capacity of Downs cells of a given geometric size, which is known and has been accepted for decades as unavoidable, variable only within narrow limits, is overcome in a simple manner.

Another special advantage is found in the fact that the space between the electrodes can be reduced from the previous value of approximately 35 to 50 mm (e.g., to values below 30 mm) by increasing the anode diameter or decreasing the cathode diameter. This is because, when the distance between the electrodes is reduced, the voltage drop between the electrodes also decreases and, as a result, the so called excess heat is reduced. In the case of the previously used cells, this would have led to a thermal deficiency, which can bring the operation of the cell to a stop. The checking of the particularly radiation caused heat discharge through the anode sleeve, vessel bottom, and vessel cover regions provided according to the invention or the provided supply of heat into one or more of these regions solves this problem in a surprisingly simple and effective manner.

The design change measures carried out according to the invention on a given conventional device for the fused salt electrolysis of alkali metal halides according to the Downs principle expand the range of application and operating safety of such devices considerably insofar as these become operable with variable current loads, without the danger of operating disturbances, with a broad variability of the current loads of, for example, 25 to 45 kA, being achieved.

The device according to the invention permits a number of advantageous configurations and modifications.

Thus, the double jacket spaces of the vessel and vessel cover can be provided with baffle plates in order to promote heat transmission in the case of the use of a gaseous heat exchange medium conducted in any desired manner, by generating turbulance.

In addition, the double shell of the vessel can be divided into several heat exchange zones in a vertical direction in order to produce a targeted effect on the heat maintenance of the melt in superposed sections.

Finally, a thermally insulating layer can be applied externally to each double shell in order to reduce the radiation of heat from the lateral and upper surfaces of the electrolysis device to the surroundings.

The housing surrounding the anode sleeves can be optionally charged with a liquid or gaseous heat exchange medium. In this case, in the housing space surrounding the current discharge sleeves and located below the second vessel bottom, the supply lines for the heat exchange medium are arranged at the bottom and the discharge lines for this medium in the upper region, with the latter being preferably arranged directly below the double bottom of the vessel.

For operation with a heat exchange liquid, the discharge line or lines for the heat exchange medium, according to an advantageous embodiment of the invention, can be formed in the housing space surrounding the current discharge sleeves and located below the second vessel bottom as a vertically adjustable overflow pipe conducted through the housing bottom, by means of which any desired liquid levels can be adjusted.

As an alternative to this, from the housing space surrounding the current discharge sleeves and located below the second vessel bottom, the discharge lines can be led out from the plane of the housing bottom through this bottom or through the housing wall and can be connected in this plane with an overflow elbow swingable from a horizontal to a vertical position.

The design change measures carried out according to the invention on a given conventional device for the fused-salt electrolysis of alkali metal halides according to the Downs principle expand the range of application and operating safety of such devices considerably insofar as these become operable with variable current loads, without the danger of operating disturbances, with a broad variability of the current load of, for example, 25 kA to 45 kA, being achieved.

The object of the invention is also a process for the operation of the new fused salt electrolysis device described. It resides in the feature that, in the case of an increase in the current load or progressive anode removal, the excess heat appearing is removed in a targeted manner through the anode sleeve and/or vessel shell and/or vessel cover region by means of positively guided heat exchange media and, in the case of a decrease in the current load, the particularly radiation caused heat discharge through the above mentioned regions is dammed or is reduced in a targeted manner by means of a supply of heat through these regions.

Depending on the amount of heat to be handled, a gas; e.g., air, or a liquid; e.g., heat transfer oil, can be used as a heat exchange medium in the double shells of the vessel and vessel cover, and water in the anode sleeve housing.

According to a special embodiment of the process according to the invention, a metal alloy, which is liquid within the temperature ranges to be adjusted, is used as a liquid heat exchange medium.

The chlorine produced in the process according to the invention is collected, purified, liquefied, and filled into containers in a first facility connected after the fused salt electrolysis operation. For reasons of safety and pollution control, a second collection point with at least the capacity of the first had to be kept on hand up to now. With the possibility created according to the invention of significantly reducing the production output of fused salt electrolysis cells according to the Downs principle, a significant margin of safety is gained in the case of the appearance of unexpected operating disturbances when the chlorine processing is switched to the second plant (which, under certain conditions, can be designed to be smaller). This is a great advantage for reasons of worker protection and pollution control, because, in this way, previously unavoidable occasional short term chlorine emissions can be restricted to a minimum.

Furthermore, in the course of the method of operation according to the invention, the excess heat removed by means of the positively guided heat exchange medium can be recovered through heat exchangers and used for appropriate uses.

The invention is explained in greater detail below, with reference to the drawing and the operating description of a conventional embodiment of the Downs cell and an embodiment according to the invention, in combination with examples for their operation. In the drawing.

Figure 1:
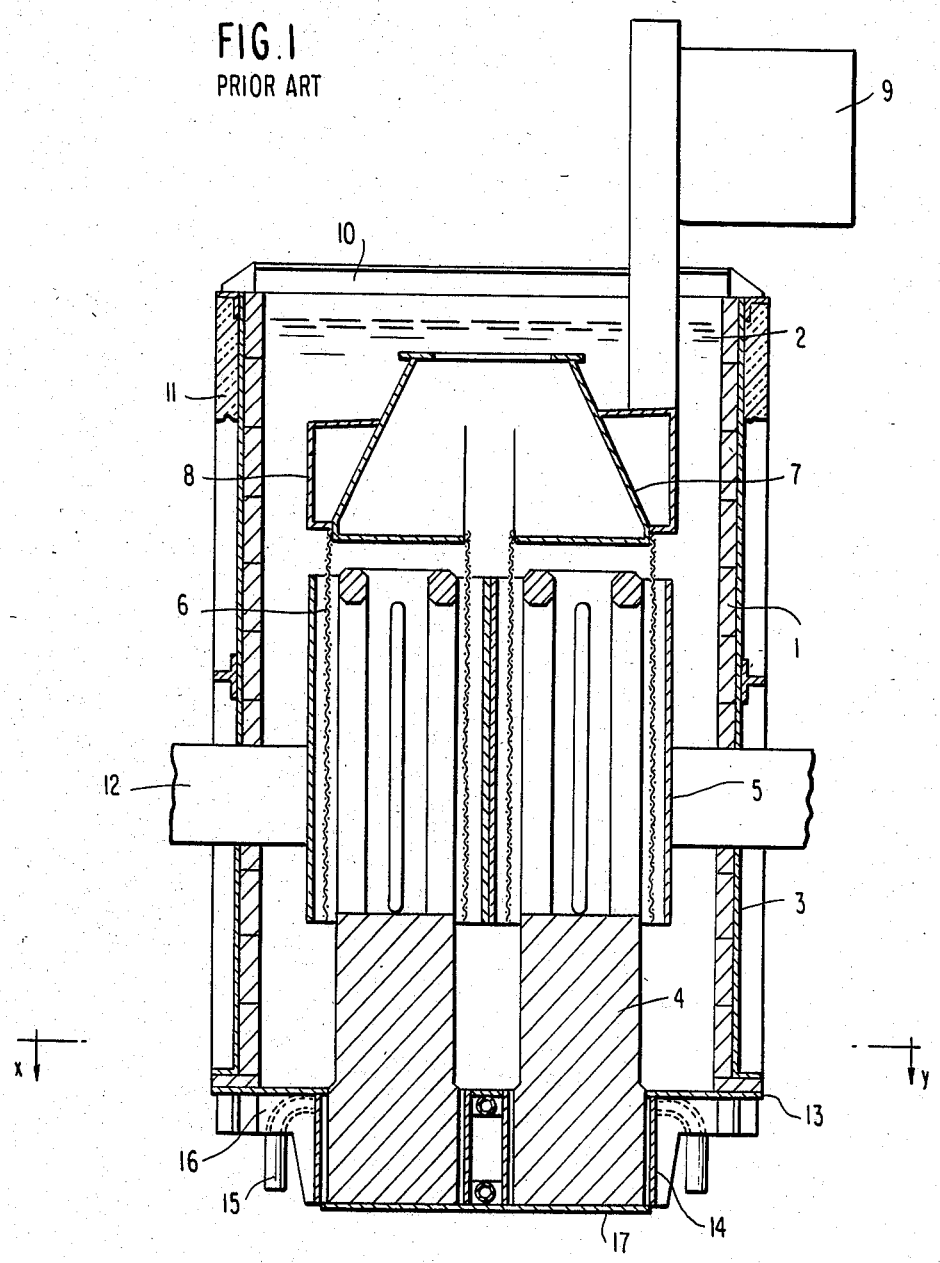
FIG. 1 PRIOR ART
FIG. 1 is a side view of a known Downs cell, in section.
Figure 2:
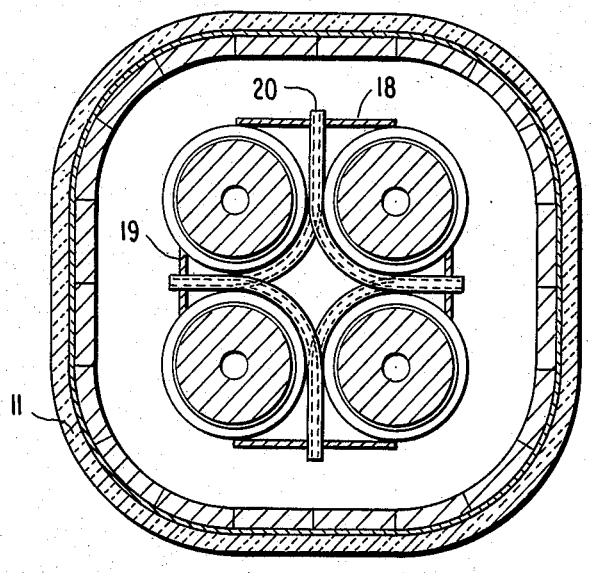
FIG. 2 PRIOR ART
FIG. 2 is a section through the cell of FIG. 1, along the section line x-y.

FIGS. 1 and 2 show a conventional embodiment of the Downs cell. The cell consists fundamentally of a vessel 3, lined refractory bricks 1 and containing the electrolyte 2, into which a graphite anode 4 is introduced from below, which is surrounded annularly by an iron cathode 5. A wire mesh screen 6 is arranged as a diaphragm in a non-contacting manner in the gap between the electrodes. To remove the chlorine formed at the anode, a sheet iron bell 7 is arranged above the anode space. Above its outer circumference, this carries the so called collector ring 8 to receive the liquid sodium deposited at the cathode. From here, the liquid sodium, because of the differences in densities of the salt melt (2.7 g/cm$^3$) and the sodium (0.8 g/cm$^3$), flows through an iron riser pipe into a storage tank 9.

Four cylindrical steel cathode pipes are welded together into a unit, surrounding an equal number of cylindrical graphite anodes (FIG. 2). The known electrolysis device thus contains a vertically arranged group of four cathode/anode pairs in the refractorily lined iron vessel 3, equipped with a cover 10, which can be provided with an externally applied thermally insulating layer 11, in which each electrode pair consists of the cylindrical iron cathode 5, which is connected with current supply arms 12, provided with cooling devices, insulated with respect to the vessel and extending out laterally therefrom, and of a cylindrical graphite anode 4, arranged concentrically within the cathode, which is located in a current discharge sleeve or "anode sleeve" 14 conducted through the vessel bottom 13 and is cast therein with the use of a low melting alloy, as well as a diaphragm 6 in each case, located in a non-contacting manner in the gap between the cathode and anode, at whose upper end there is provided the previously mentioned sheet iron bell device 7, and collector ring 8 for the separate collection of metal and halogen, insulated with respect to the vessel, and where a housing 16 equipped with supply lines for a heat exchange medium is arranged below the bottom of the vessel in the region of the anode sleeves, whose cover consists of the vessel bottom 13, and on whose bottom 17 the anode sleeves are placed.

The housing 16 also contains discharge lines 15 as an overflow, starting above the bottom of the housing, to limit the height of rise of the cooling liquid. In the case of the conventional symmetrical, approximately square arrangement of the four electrode pairs located at a distance from each other, two opposite parallel walls 18 of the housing, in each case, are located as tangents at the circumference of two anode sleeves, while the remaining two housing walls 19, which are also parallel to each other, are set back somewhat into the gap between the anode sleeves (FIG. 2).

The housing walls welded to the shells of the anode cylinders along their lines of contact accordingly enclose a cooling space that is limited to a segment of approximately 61% of the cross-section of each anode sleeve, while the externally located segments are not subjected to the action of coolant.

The housing walls 19 are therefore themselves usually arranged between the anode sleeves in such a way that the sleeves themselves represent a part of the housing walls. As a result, the surfaces of the anode sleeves are located to the extent of only approximately 61% within the housing, so that they can be acted upon by cooling media only on these partial surfaces.

In addition, an additional indirect cooling of the anode sleeves is made possible in each case by two pairs of cooling pipes 20 located above one another, arranged below the bottom of the vessel and conducted centrally through each of the four side walls of the cooling housing, with the first pipe of a first pair, in each case, looping around the internal shell region of an adjacent first anode sleeve in a clockwise direction and the second pipe looping around the same shell region of the adjacent second anode sleeve approximately semicircularly in a counterclockwise direction and leaving the housing above or below the penetration of the pipes of the cooling pipe pair looping around the two opposite anode sleeves perpendicularly to the direction of entry (see FIG. 1).

Figure 4:
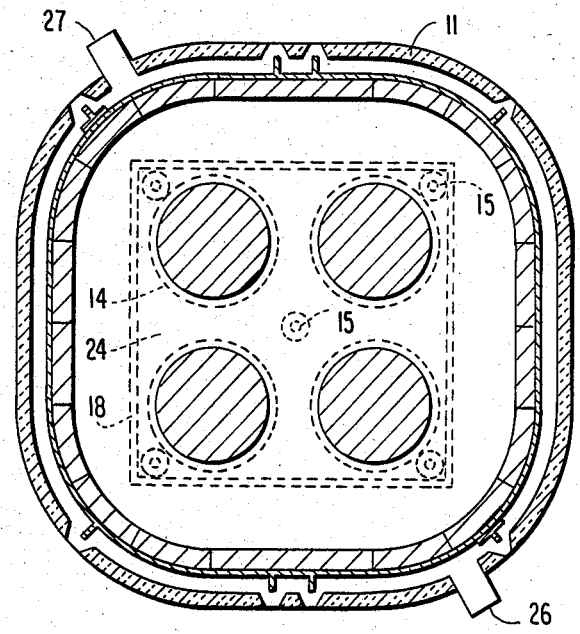
FIG. 4 is a section through the cell of FIG. 3, along the section line x-y.
Figure 3:
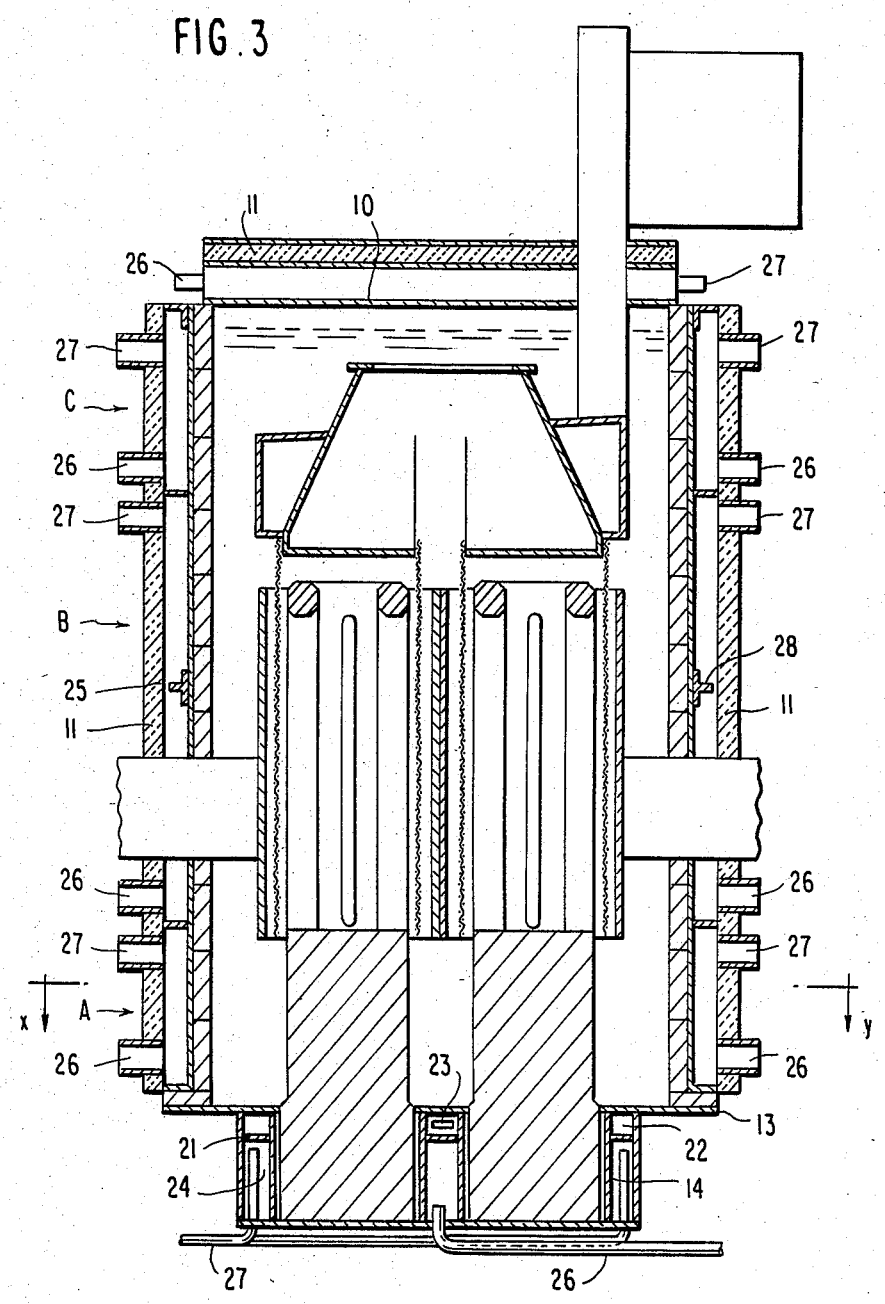
FIG. 3 is a side view of a Downs cell according to the invention, in section.
Figure 5:
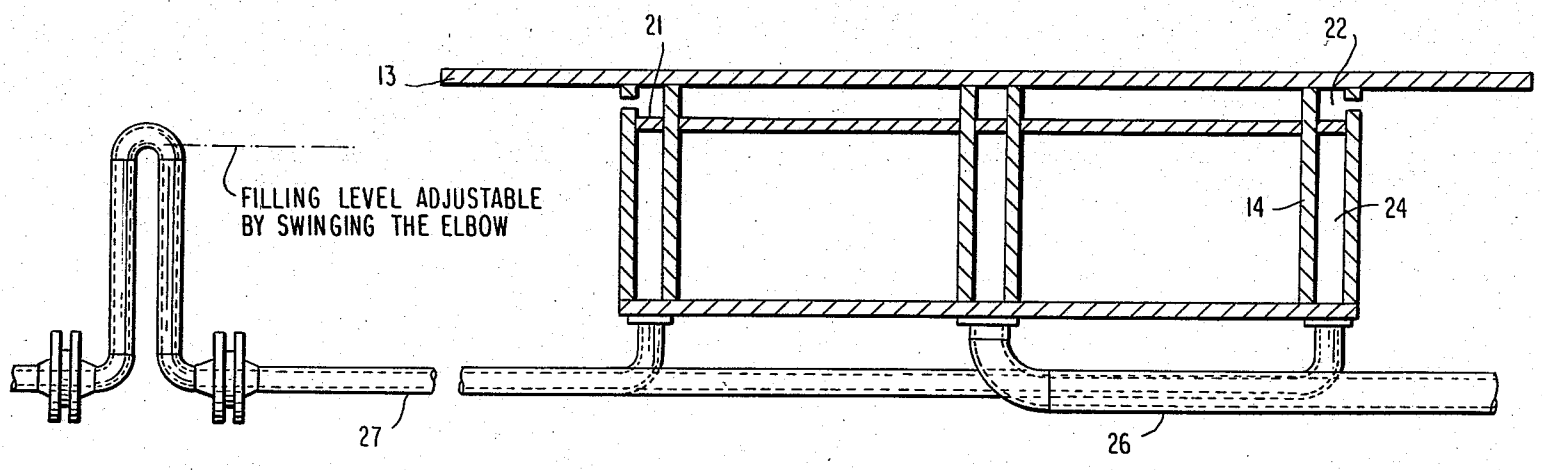
FIG. 5 is an enlarged side view of the lower part of the cell of FIG. 3.

The device according to the invention shown in FIGS. 3–5, includes a second bottom 21 located below the vessel bottom 13 but above discharge lines for the heat exchange medium and tightly connected with the walls of the housing, there is a space 22 being formed between the vessel bottom and the second bottom, which is provided with lateral control openings 23. The housing 24 located below the second bottom 21 completely surrounds the cylinder shells of the current discharge sleeves 14, and the shell 25 of the vessel and the vessel cover 10 is always designed as a closed double shell, equipped with supply and discharge lines (26 and 27) for a heat exchange medium.

The second bottom 21 located at a clear distance of approximately 50 mm below the vessel bottom is welded to the walls of the housing 24 surrounding the anode sleeves 14, which is preferably approximately square, and to the cylinder shells of the anode sleeves and forms a double bottom together with the vessel bottom 13. In this way, a cavity 22 is formed below the vessel bottom, which is provided with the above mentioned lateral openings 23.

The double shell of the vessel is divided into three zones in a vertical direction, which can be acted upon independently by a heat exchange medium:

The lower first zone extends from the plane of the bottom lining to the plane of the lower edge of the cathodes. From there, the central second zone extends to the plane of the collector ring with the collecting bell, and this is followed by the upper third zone, up to the upper edge of the vessel.

Each zone is provided with supply and discharge lines for the heat exchange medium and can be brought to the temperature required for the maintenance of optimal circulation of the melt independently of the neighboring zone.

Finally, a thermally insulating layer is applied to the outside of the double shell of the vessel 3 and cover 10, in order to reduce the radiation of heat from the lateral and upper surfaces of the electrolysis device to the surroundings. The double shell spaces of the vessel and vessel cover may be provided with baffle plates 28.

The housing 24 surrounding the anode sleeves can be charged optionally with a liquid or gaseous heat exchange medium. In this case, in the housing 24 surrounding the current discharge sleeves and located below the second vessel bottom, the supply lines 26 for the heat exchange medium are arranged at the bottom and the discharge lines 27 for this medium in the upper region (FIG. 3), with the latter being preferably located directly below the double bottom of the vessel.

For operation with a heat exchange liquid, in the housing 24 surrounding the current discharge sleeves 14 and located below the second vessel bottom 21, the discharge line 27 for the heat exchange medium is designed as a vertically adjustable overflow pipe conducted through the housing bottom, by means of which any desired liquid levels can be adjusted.

The method of operation and function of the above described fused salt electrolysis device according to the invention are explained below by means of the dimensioning and procedure in the case of normal, increased, and reduced current load.

A sheet iron vessel 2550 mm in height, with an approximately square base with rounded off corners (edge length 1785 mm) is equipped with a firebrick lining 76 mm in thickness. A group of four electrode pairs is arranged in the vessel around the central axis of the vessel. The clear space between the cathodes and lining is approximately 160 mm. The length of the graphite anodes is 2040 mm and the cathode length, measured from the upper edge of the anodes, is 1220 mm. The anode diameter is 438 cm and the cathode diameter 508 cm. A wire mesh screen of the cathode length is used as a diaphragm. The anodes are located, in each case, in a sleeve conducted through the bottom of the vessel which, in turn, are placed on the bottom of the housing 24. The charging device for the electrolyte and devices for the separate collection of metal and halogen are designed in the usual manner.

The space 22 within the double bottom has a height of 50 mm and is provided at its upper edge with four venting and control slots 23, each 10 mm in height and 200 mm in length, symmetrically opposite each other.

The housing 24 surrounds the cylindrical current discharge sleeves at a distance of 46 mm.

The total shell and the supporting cover of the vessel are designed as a double shell with a distance of 60 mm between the two shells. Both double shells are thermally insulated on the outside with a rock wool layer 50 mm in thickness. The cover is equipped with supply and discharge connections for the heat exchange medium, located opposite each other.

The device is filled with approximately 6000 kg of electrolyte (48 weight percent $BaCl_2$, 24 weight percent $CaCl_2$, and 28 weight percent NaCl) up to the upper edge of the electrodes and the filling is melted to a depth of approximately 30 mm with oil burner, directed at the filling from above, with the cover removed. As a result of a gradually increasing current flow, the whole electrolyte charge is then liquefied and additional electrolyte is charged in to 10 cm below the edge of the vessel. This is followed by insertion of the diaphragm. The electrolysis products formed cause a circulation of the melt. During this process, the current supply arms for the cathodes are cooled with 500–800 liters/hour of water at 18° C. The cell voltage is 6.3 V. The housing space 24 is supplied with cooling air at room temperature through the lines 26 and 27 in such a way that a temperature of 360°–400° C. is established at the vessel bottom 13, which is separated from the electrolyte by a zirconium orthosilicate cement layer 200 mm in thickness. The measuring point is located at the center of the vessel bottom (below the layer of zirconium orthosilicate cement). In the case of a current flow of 40 kA, the cell produces approximately 725 kg of sodium per day and approximately 1800 kg of chlorine. The electrolyte temperature (measured at the end of the third zone) in this case is approximately 590° C. This method of operation of the device according to the invention still corresponds, in part, to those of the state of the art. It does not provide any differentiated heat control in the three zones of the double shell of the vessel and in the cover, but does use a targeted temperature adjustment at the bottom of the vessel.

The current load is now increased to 47 kA. The cell voltage increases to 7 V during this process. The daily production capacity of the cell increases to approximately 880 kg of sodium and the equivalent amount of chlorine. The quantity of the salt mixture continuously supplied is exactly adjusted to the altered sodium output, in order not to change the circulation of the liquid electrolyte as a result of salt deposition.

In order to keep the temperature at the bottom of the vessel at 360°–400° C., the flow of cooling air through the housing 24 is approximately increased or is changed over to a corresponding cooling with heat transfer oil. The first zone of the double shell of the boiler initially remains uncooled. The second zone is acted on by a flow of cooling air of approximately 1000 meters$^3$/hour at room temperature and the third zone by a stream of cooling air of 500 meters$^3$/hour. As a result, a temperature of 580°–590° C. is established in the melt at the end of the third zone. The cover can also be cooled, if necessary, to maintain this temperature.

In the case of trouble-free operation, an increase of 21% in production is obtained.

The current load is now reduced to 25 kA. The cell voltage decreases to 5.5 V in the process. The daily production capacity of the cell decreases to approximately 340–370 kg of sodium. The quantity of the continuously supplied salt mixture is exactly adjusted to the altered sodium output in order not to change the circulation of the liquid electrolyte by salt deposition.

In order to maintain a temperature of 350°–360° C. at the bottom of the vessel, the flow of cooling air through the housing 24 and through the three zones of the double shell of the vessel is stopped; the cover also remains uncooled. The temperature of the melt at the end of third zone is between 580° and 595° C.

In the case of trouble-free operation, a decrease of 50% in sodium product, as compared with the previous method of operation with 40 kA, is achieved.

The measures to be applied according to the invention in the case of an increase in the current load can also be applied in the case of advanced anode wear, which makes an increased heat removal necessary in order to maintain optimal operation. Hence, controlled management of heat conditions is possible.

When the current load drops below 25 kA, an operation of the cell according to the invention can be maintained by a supply of heat by means of hot air or heated heat transfer liquid, particularly in those regions in which the melt has a particular tendency toward local solidification (e.g., in zone 1).

Additional modifications and variations of the invention will become apparent to those skilled in the art from a study of the foregoing and are, accordingly, intended to be encompassed by the claims appended hereto.

We claim:

1. A device for the fused salt electrolysis of alkali metal halides by the Downs principle operable with a variable current load over an expanded range, comprising a vertically arranged group of a plurality of electrode pairs disposed in a refractorily lined vessel equipped with a cover, in which each electrode pair comprises a cylindrical cathode which is connected to current supply arms provided with cooling devices, insulated with respect to the vessel and laterally extending therefrom, a cylindrical graphite anode arranged concentrically within the cathode, which is located in a current discharge sleeve conducted through the bottom of the vessel and is cast therein with the use of a low melting alloy, a diaphragm, located in a noncontacting manner in the gap between said cathode and anode, the upper end thereof being provided with a device for the separate collection of metal and halogen and insulated with respect to the vessel, a housing equipped with supply and discharge lines for a heat exchange arranged below the bottom of the vessel proximate the current discharge sleeves, the cover of which consists of the bottom of the vessel, and on the bottom of which the current discharge sleeves are placed, and a second bottom arranged below the bottom of the vessel, but above the discharge lines for heat exchange medium and tightly connected with the walls of the housing, there being a space formed between the bottom of the vessel and the second bottom, the housing space located below the second bottom completely surrounding the cylinder shells of the current discharge sleeves and the shell of the vessel and the vessel cover being designed as a closed double shell provided with supply and discharge lines for a heat exchange medium.

2. The device as set forth in claim 1, further comprising said plurality of electrode pairs being four in number.

3. The device as set forth in claim 1, further comprising said vessel being iron.

4. The device as set forth in claim 3, further comprising said cathode being iron.

5. The device as set forth in claim 1, further comprising the space between the bottom of the vessel and the second bottom being provided with lateral openings.

6. The device as set forth in claim 1, further comprising the double shell spaces of the vessel and vessel cover being provided with baffle plates.

7. The device as set forth in claim 1, further comprising the double shell of the vessel being divided into several heat exchange zones in a vertical direction.

8. The device as set forth in claim 1, further comprising a thermally insulating layer being applied to the double shells of the vessel and vessel cover.

9. The device as set forth in claim 1, further comprising in the housing space surrounding the current discharge sleeves and located below the second bottom supply lines for the heat exchange medium being arranged at the bottom and the discharge lines for this medium being arranged in the upper region.

10. The device as set forth in claim 1, further comprising in the housing space surrounding the current discharge sleeves and located below the second bottom discharge line for the heat exchange medium being designed as a vertically adjustable overflow pipe conducted through the bottom of the housing.

11. The device as set forth in claim 1, further comprising wherein from the housing space surrounding the current discharge sleeves and located below the second bottom, the discharge lines are led out from the plane of the housing bottom through this bottom or through the housing wall and are connected in this plane with an overflow elbow swingable from a horizontal to a vertical position.

12. A process for producing an alkali metal by electrolysis of a fused halogen salt of the alkali metal by operation of a fused salt electrolysis device having a current discharge sleeve comprising removing excess heat caused by an increase in the current load or progressive anode wear, through the current discharge sleeve region and/or vessel region and/or vessel cover region in a controlled manner by contacting with positively guided heat exchange media in a zone surrounding the said region and, in the case of a decrease in the current load, the particularly radiation caused heat discharge through the above mentioned regions is dammed or is reduced in a controlled manner by contact with a supply of heat in a zone surrounding these regions.

13. The process as set forth in claim 12, further comprising a liquid or a gas being used as a heat exchange medium.

14. The process as set forth in claim 13, further comprising a metal alloy that is liquid within the temperature regions to be adjusted being used as a liquid heat exchange medium.

* * * * *